United States Patent [19]

Kishimoto et al.

[11] 4,024,227

[45] May 17, 1977

[54] PROCESS FOR PRODUCING CARBON FIBERS HAVING EXCELLENT PROPERTIES

[75] Inventors: Soichiro Kishimoto; Saburo Okazaki, both of Okayama, Japan

[73] Assignee: Japan Exlan Company Limited, Osaka, Japan

[22] Filed: Oct. 30, 1975

[21] Appl. No.: 627,469

[30] Foreign Application Priority Data

Nov. 7, 1974 Japan ..... 49-128679

[52] U.S. Cl. ..... 423/447.4; 423/447.6; 423/447.7; 264/29.2

[51] Int. Cl.[2] ..... C01B 31/07

[58] Field of Search ..... 423/447, 447.4, 447.6, 423/447.7; 264/29, 29.2; 8/115.5; 528/481, 492

[56] References Cited

UNITED STATES PATENTS

| | | | |
|---|---|---|---|
| 2,758,003 | 8/1956 | Kleiner et al. | 8/115.5 |
| 3,632,798 | 1/1972 | Morita | 528/481 |
| 3,720,759 | 3/1973 | Overhoff | 423/447 |
| 3,767,773 | 10/1973 | Turner et al. | 423/447 |
| 3,814,577 | 6/1974 | Menikheim | 8/115.5 |
| 3,817,700 | 6/1974 | Menikheim | 8/115.5 |

*Primary Examiner*—Edward J. Meros

*Attorney, Agent, or Firm*—Wenderoth, Lind & Ponack

[57] ABSTRACT

A process for producing a carbon fiber having high tensile strength and high modulus of elasticity which comprises heat-treating an acrylonitrile fiber impregnated with at least one compound selected from specific primary amines and/or quaternary ammonium salts so that an acrylic fiber which is partly insoluble in a concentrated aqueous solution of sodium thiocyanate is obtained; thermally stabilizing said partly insoluble acrylic fiber; and then carbonizing said thermally stabilized fiber.

12 Claims, 2 Drawing Figures

PROCESS FOR PRODUCING CARBON FIBERS HAVING EXCELLENT PROPERTIES

The present invention relates to a process for producing a carbon fiber (including graphite fiber; also hereinafter) having high physical properties by using an acrylonitrile fiber (abbreviated as AN fiber hereinafter) as the starting material (so-called "precursor") for obtaining said carbon fiber. More particularly, the invention is concerned with a process for producing a carbon fiber of high tensile strength and high modulus of elasticity in an industrially advantageous manner by heat-treating an AN fiber impregnated with at least one compound selected from specific primary amines and/or quaternary ammonium salts, under specified conditions; thermally stabilizing said fiber and then carbonizing said thermally stabilized fiber, whereby the productivity throughout the whole process including the step of producing the precursor fiber and the step of producing the carbon fiber is heightened, and at the same time troubles such as filament fluffiness and yarn breaking are eliminated.

It is already known to obtain carbon fibers which are excellent for use in reinforcing materials, exothermic elements, heat-resisting materials, etc. by heating an AN fiber in an oxidizing atmosphere at 200° – 400° C. so as to form a cyclized structure in the fiber and carbonizing the cyclized fiber in a non-oxidizing atmosphere at a higher temperature (normally above 800° C.).

However, the so-called stabilization step, which is the step of forming naphthyridine rings in the AN fiber by heat-treating the fiber in an oxidizing atmosphere, is a very important step that governs the physical properties of the carbon fiber, the final product. It has been thought that this step requires a heat-treating operation under tension for a long period of time, and this has been the cause of the low productivity of carbon fibers.

If a condition of high-temperature thermal stabilization or an operation of sharp temperature rise is employed in order to heighten the productivity of carbon fibers, abrupt reactions such as intermolecular cross-linking and intramolecular cyclization will occur at a temperature about the exothermic transition point of the fiber. Accompanied with such reactions, local accumulation of heat takes place which causes an uneven reaction to produce a pitch-like or tar-like substance. Such a substance causes mutual adhesion of filaments or exerts an evil influence on the physical properties of the carbon fiber, for example a decrease in mechanical strength. Also, in the case of applying tension to AN fibers in the thermal stabilization step in order to obtain thermally stabilized fibers capable of producing carbon fibers having excellent properties, it has been extremely difficult to fire the fibers at a determined extension ratio because the modulus of elasticity or the extension-susceptible region of the AN fibers upon firing is variously different depending on the firing temperature.

Therefore, various processes have been proposed to accelerate the cyclization reaction so that thermally stabilized fibers can be obtained in a short time. All these processes, however, have not necessarily contributed to the improvement in economy and industrial productivity of carbon fibers of high physical properties, because such processes are those copolymerizing a special comonomer with the fiber-forming polymer, or employing a treatment with a special or harmful chemical, or employing a complicated thermal stabilization step.

On the other hand, precursor AN fibers have not been subjected to oiling treatment because the fibers may adhere to each other upon firing. Therefore, the bundling of the filaments is not good enough in the production step, and various troubles are also caused which exert a grave influence on the properties of carbon fibers, such as filament breaking, fluffiness and disorder of filaments due to the generation of static electricity caused by the friction by rollers.

In view of such a situation, we made an intensive study to overcome the above-mentioned defects and to obtain high quality carbon fibers in an industrially advantageous manner. As a result, we have found that, by heat-treating, under a specified conditions, an AN fiber to which at least one compound sselected from specific primary amines and/or quaternary ammonium salts has been applied in the fiber production step and then firing the fiber, all troubles such as fluffiness, filament breaking, disorder of fibers, etc. of the precursor yarn are removed, and at the same time the firing time is shortened to a large extent and the tension applying operation upon firing is facilitated, so that a carbon fiber of high physical properties can be produced in an industrial manner.

The principal object of the present invention is to produce a carbon fiber having excellent properties in an industrially advantageous manner.

An object of the present invention is to provide a carbon fiber of high tensile strength and high modulus of elasticity by short-time firing while eliminating the troubles such as fluffiness, filament breaking and disorder of fibers.

Another object of the present invention is to provide a process which will improve the productivity and operability throughout the whole process from the precursor yarn production step to the carbon fiber production step, and which enables the production of a high quality carbon fiber, by heat-treating, under specified conditions, an AN fiber to which at least one compound selected from specific primary amines and/or quaternary ammonium salts has been applied in the fiber production step.

These and other objects and features of the present invention will be better understood upon consideration of the following detailed description and accompanying drawings in which.

Figure 1:
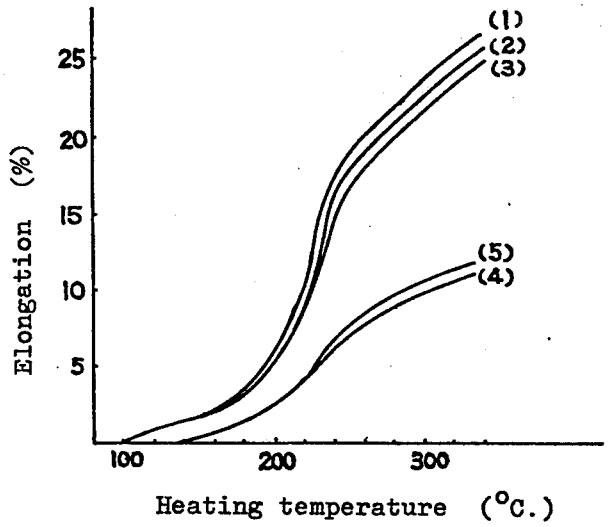
FIG. 1 represents how various acrylonitrile fibers extend upon heating.

The above-mentioned objects of the present invention are attained by impregnating a water-swollen AN fiber containing at least 85 mol percent acrylontrile with 0.05 – 5%, based on the dry weight of the fiber, of at least one compound represented by the following general formula (I) or (II):

$$R_1 - NH_2 \qquad (I)$$

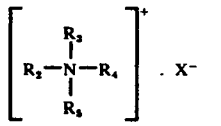

(II)

wherein $R_1$ is a hydrocarbon group containing 7 – 16 carbon atoms; $R_2$, $R_3$, $R_4$ and $R_5$ are each a hydrocarbon group containing 1 – 16 carbon atoms, with at least one of $R_2$, $R_3$, $R_4$ and $R_5$ being a hydrocarbon group containing 7 – 16 carbon atoms; and X is a monovalent anion, heat treating the fiber at a temperature of at least 150° C. for 0.1 second to 30 minutes so as to render the fiber to have 20 – 80 weight percent undissolved matter upon being immersed in a 60 % aqueous sodium thiocyanate solution at 80° C. for 20 minutes; and then firing the fiber in the usual way to carbonize or graphitize the fiber.

It is supposed that, by heat-treating, under specified conditions, an AN fiber impregnated with at least one compound selected from specific primary amines and/or quaternary ammonium salts, initiating points of dehydration, cyclization, cross-linking, etc. might be formed within the fiber. Such initiating points may accelerate the intramolecular cyclization of nitrile groups, dehydration reaction and cross-linking reaction by oxidation in the thermal stabilization step and make these reactions proceed moderately to the core of the fiber. Thus, the exothermic reaction accompanying the deterioration and decomposition of the fiber is effectively controlled and mutual adhesion of filaments due to abrupt local accumulation of heat does no occur. Accordingly, it is now possible to employ an operation of sharp temperature rise or a condition of high-temperature thermal stabilization and to shorten the firing time remarkably.

At the same time, by employing the process of the present invention, the extensibility of the region of AN fibers susceptible to extension upon firing is suppressed and the fiber represents a stable extension throughout the whole range of the thermal stabilization temperatures so that the tension acts uniformly on the fiber to make the operation of tension application very easy. This advantageously prevents the fiber breaking at the extension-susceptible region and makes it possible to produce a thermally stabilized fiber at a desired percent extension. FIG. 1 shows several curves of the variation of extension of AN fibers, when the fibers, after being impregnated with 0.5% of various compounds respectively and heat-treated at 210° C. for 3 minutes at a definite length, are heated from 80° C. at a temperature rise speed of 3° C./min. in air under a constant tension of 0.29 g/d. The fiber 1 not impregnated with any compound, the fiber 2 impregnated with sulfosuccinic acid ester and the fiber 3 impregnated with sorbitan monolaurate begin to extend at about 100° C. and represent an abrupt increase of extension with the rise of temperature. On the other hand, the fiber 4 impregnated with decylamine and the fiber 5 impregnated with decyl trimethylammonium chloride begin to extend to about 160° C. and represent a stable extension as a whole, with the abrupt extension in the temperature range of 180° – 240° C. being suppressed. This fact on one hand shows the difficulty of tension control at the initial stage of the thermal stabilization step if this step is not carried out according to the present invention, and on the other hand shows that when this step is carried out according to the present invention the tension control is easy because the abrupt variation in extension is suppressed in the thermal stabilization step and that the molecular arrangement of the AN fiber, the precursor fiber, will not be impaired.

Further, since the above-mentioned primary amines and/or quaternary ammonium salts are applied to AN fibers in the fiber production step, the generation of static electricity due to friction by rollers is suppressed. Therefoe, the troubles, such as filament breaking, generation of fluffs and disorder of fibers, which may exert an evil influence on the properties of carbon fibers, are advantageously eliminated so that it is not possible to improve the efficiency in continuous operation for producing precursor fibers and to better the uniformity in the quality of the fibers.

The AN fibers as referred to herein used in the present invention are those produced from a homopolymer of acrylonitrile or an acrylonitrile copolymer containing acrylonitrile in an amount of at least 85 mol %, preferably at least 90 mol %. Among the copolymer components may be recited well-known ethylenically unsaturated compounds such as: allyl alcohol, methallyl alcohol, β-hydroxypropyl acrylonitrile, acrylic acid, methacrylic acid, itaconic acid, crotonic acid, methacrylonitrile, α-methylene glutaronitrile, isopropenyl acetate, acrylamide, N-methylol acrylamide, β-hydroxyethyl methacrylate, dimethylaminoethyl methacrylate, vinylpyridine, vinylpyrrolidone, methyl acrylate, methyl methacrylate, vinyl acetate, acryl chloride, sodium methallylsulfonate, potassium p-styrenesulfonate, etc. Such a homopolymer or copolymer of acrylonitrile is generally produced in the well-known polymerization systems such as solvent polymerization system, mass polymerization system, emulsion polymerization system or suspension polymerization system. The solvents used upon producing AN fibers from these polymers include organic colvents such as dimethyl-formamide, dimethylacetamide and dimethyl sulfoxide; and inorganic solvents such as aqueous solutions of nitric acid, zinc chloride and sodium thiocyanate. Such a polymer solution is spun to form filaments in the usual way. Among the spinning processes, particularly suited are the wet-spinning process by which an AN fiber in a water-swollen state can be easily obtained and the dry-wet-spinning process in which the polymer solution is extruded through spinning orifices into an inert gas atmosphere and then introduced into an aqueous coagulating bath to form coagulated filaments.

In the spinning process, the filaments are dried after the filaments have been subjected to a water-washing operation for removing the solvent in the fiber and a stretching operation for orientating the fiber molecules (generally at a stretching ratio in excess of 3 times the length, preferably in excess of 4 times, in hot water and/or steam). The water-swollen AN fibers to be impregnated with the specified primary amines and/or quaternary ammonium salts according to the present invention are those before the drying operation. If the primary amines and/or quaternary ammonium salts according to the present invention are applied to a fiber after drying, such compounds will not sufficiently penetrate into the core of the fiber so that it will become difficult to fully attain the intended objects of the present invention.

Upon applying the primary amines and/or quaternary ammonium salts according to the present invention to the water-swollen fiber, it is desirable to adjust the water content = (water-swollen fiber weight − dry fiber weight) × 100/dry fiber weight at 20 – 200%. When a fiber of a water content outside that range is used, the penetration of the compounds into the interior of the fiber will be poor and it becomes difficult to put the compound on the fiber continuously and evenly.

The primary amines or quaternary ammonium salts which display an excellent effect when applied to such a water-swollen fiber, are those represented by the following formula:

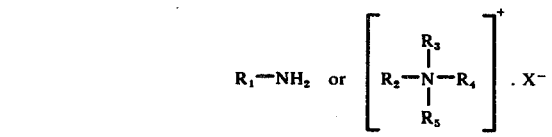

wherein $R_1$ is a hydrocarbon group containing 7 – 16 carbon atoms and $R_2$, $R_3$, $R_4$ and $R_5$ are each a hydrocarbon group containing 1 – 16 carbon atoms, with at least one of $R_2$, $R_3$, $R_4$ and $R_5$ being a hydrocarbon group containing 7 – 16 carbon atoms, and X is a monovalent anion, e.g. a chloride or bromide ion. For example, primary amines and quaternary ammonium salts whose hydrocarbon groups of 7 – 16 carbons are heptyl, octyl, nonyl, decyl, undecyl, dodecyl, tridecyl, tetradecyl, pentadecyl, cetyl, may be recited. However, among them higher aliphatic amines and higher alkyl quaternary ammonium salts are particularly preferred.

Such compounds are applied to the water-swollen fiber as an aqueous solution generally of 0.01 – 10%, preferaby of 0.05 – 7%, and it is necessary that the fiber should be made to contain the compounds in an amount of 0.05 – 5%, preferably 0.1 – 3% based on the dry weight of the fiber. If the content of such compounds in the fiber is too low, the effect of the present invention can not be fully achieved. On the other hand, a better effect cannot be expected from too high a content of the compounds, so that such a high content is not economical. It is of course possible to obtain help of a penetrating agent to facilitate the penetration of the compounds.

The water-swollen AN fiber given the primary amines and/or quaternary ammonium salts according to the present invention is normally subjected to drying in order to collapse voids present within the fiber so as to compact or dense the fiber structure. Generally, such drying treatment is performed at a temperature between about 80° C. and about 150° C. for about 1 second to about 3 minutes.

The thus-obtained AN fiber containing such a specified amount of such specified primary amines and/or quaternary ammonium salts must be subjected to a specified heat treatment prior to the firing operation for producing the carbon fiber. Without such heat treatment, it is impossible to display the excellent features of the present invention in the carbon fiber production process. The heat treatment must be performed at a temperature above at least 150° C. for 0.1 second to 30 minutes, preferably 0.2 second to 20 minutes. The upper limit of the treating temperature is about 650° C. At a temperature exceeding this temperature, the fiber is susceptible to breakage and thus such a temperature is not desirable. The preferred treating temperatures range from 160° C. to 550° C. By this treatment, a yellow or brown colored fiber is obtained. It is necessary that a heat treatment condition should be employed such that undissolved matter of 20 – 80 weight percent will remain upon immersing the fiber in a 60 % aqueous sodium thiocyanate solution maintained at 80° C. for 20 minutes. When the undissolved matter is less than 20% by weight, the heat treatment will be insufficient and therefore the effect of the present invention in the firing steps is not fully displayed. When the undissolved matter is in excess of 80% by weight, the fiber will become brittle and therefore various troubles are caused in the firing steps, especially in the thermal stabilization step. The heat-treated fiber representing such a solubility in a 60% aqueous sodium thiocyanate solution can be obtained by employing a suitable condition within the range of the above-mentioned treating temperatures and treating time periods. The temperature-time shown in FIG. 2 by the slanting lines (the area surrounded by the lines connecting A, B, C and D) is generally used advantageously. In such heat treatment, a tension generally of 0.1 – 0.5 g/d, preferably of 0.18 – 0.45 g/d is usually applied to the fiber so that the fiber can be maintained at a definite or extended length or a controlled shrinkage. Such heat treatment may be done in another step different from the above-mentioned drying step or may be performed simultaneously with said drying treatment. Any method may be employed so far as the AN fiber containing the above-specified compounds are subjected to the above heat treatment.

Upon producing carbon fibers from AN fibers subjected to such a specified heat treatment, any known firing method may be employed. Generally, however, a firing method is preferred which comprises a first firing step (so-called thermal stabilization step) in which the fiber is heated at 150° – 400° C. in an oxidizing atmosphere and a second firing step in which the thermally stabilized fiber is heated at a higher temperature (normally above 800° C.) in a non-oxidizing atmosphere to carbonize the fiber or graphitize the fiber after carbonization. Although air is suitable as the atmosphere for use in thermal stabilization, the fiber may be thermally stabilized in the presence of sulfur dioxide gas or nitrogen monoxide gas or under irradiation of light. For carbonization, a temperature generally of 800° – 2,000° C. is employed and for further graphitizing the carbon fiber thus obtained, a temperature generaly of 2,000° –3,500° C. is employed. Among the atmospheres for use in such carbonization or graphitization, nitrogen, hydrogen, helium and argon are preferred. To obtain a carbon fiber having a better tensile strength and modulus of elasticity, it is preferable to heat the fiber under tension (normally 0.1 – 0.5 g/d) as is generally known. It is particularly effective to apply tension at the time of thermal stabilization and carbonization or graphitization. The carbonization or graphitization may be carried out under reduced or increased pressure.

By employing such a process of the present invention, it is now able to produce a carbon fiber very excellent in tensile strength and modulus of elasticity at a high productivity and in a short time. Accordingly, the carbon fiber having such excellent properties can be advantageously used in the wide field of reinforcing materials, exothermic elements, refractory materials, etc.

For a better understanding of the present invention, representative examples of the invention are given hereunder.

EXAMPLE 1

A spinning solution obtained by dissolving 15 parts of an AN copolymer containing 98% AN into a 48% aqueous sodium thiocyanate solution was extruded through a spinnerette into air, and was introduced into a 12% aqueous sodium thiocyanate solution to form coagulated filaments. The fiber was washed with water and then stretched four times the length in boiling water and further stretched two times in superheated steam to obtain an AN fiber in a water-swollen state having a water content of 135% and having a single filament fineness of 1.5 denier.

The water-swollen fiber thus obtained was impregnated with 0.5 aqueous solutions of the various compounds shown in Table 1, respectively and dried at 120° C. for 3 minutes. These fibers containing each compound were heat-treated at 230° C. for 1 minute at a definite length. By immersing each fiber thus obtained in a 60% aqueous sodium thiocyanate solution, the percent undissolved matter in said thiocyanate solution was measured. Each heat-treated fiber was subjected to thermal stabilization treatment at 230° C. for 3 hours in air at a definite length. These thermally stabilized fibers were examined for the mutual filament adhesion. The results are shown in Table 1.

Generally, with the progress of the heat decomposition of the fiber, the solubility of the fiber in the aqueous thiocyanate solution lowers, i.e. the ratio of the undissolved matter increases. The results in Table 1 shows that the accelerating effect on the heat decomposition of the fiber by dodecylamine or dodecyl trimethylammonium chloride is extremely high when they are used according to the present invention. The compounds according to the present invention not only accelerate the heat decomposition but also nicely prevent the mutual adhesion among the filaments in the thermal stabilization step. Therefore, the thermal stabilization operation becomes very easy.

Table 1

| Compound | | Undissolved matter (%) in aqueous sodium thiocyanate | Adhesion |
|---|---|---|---|
| Kind | Content (%) | | |
| Not treated | — | 4 | occurred |
| POE(10) nonyl phenyl ether | 1.48 | 4 | slightly occurred |
| POE(10) palmityl ester | 1.51 | 5 | " |
| POE(10) sorbitan monopalmitate | 1.60 | 5 | occurred |
| POE(10) cater oil | 1.41 | 5 | " |
| POE(7) lauryl phosphate | 1.50 | 4 | " |
| Sorbitan monolaurate | 1.76 | 6 | occurred |
| Vegitable oil | 1.23 | 2 | did not occur |
| Mineral oil | 1.10 | 2 | " |
| Dodecylamine | 1.51 | 23 | " |
| Dodecyl trimethyl-ammonium chloride | 1.70 | 22 | " |

EXAMPLE 2

The water-swollen fiber obtained in Example 1 was treated with aqueous dodecylamine solutions in the various concentrations shown in Table 2 and was subjected to drying treatment at 120° C. for 3 minutes to obtain 5 kinds of fibers containing different amounts of the amine.

These fibers of different amine contents were treated under the same heat treating condition as in Example 1 and were examined for the heat decomposition accelerating effect and the adhesion preventing effect by the same evaluation method as in Example 1. The results are shown in Table 2.

As apparent from the results in Table 2, with the increase of dodecylamine content, the heat decomposition accelerating effect is low, while a content in excess of 5%, filament adhesion is observed, and thus such a content is not economical and not practical.

Table 2

| Dodecylamine treating bath concentration (%) | Dodecylamine content (%) in the fiber | Undissolved matter (%) in aqueous sodium thiocyanate | Adhesion |
|---|---|---|---|
| 0.01 | 0.03 | 13 | slight |
| 0.02 | 0.06 | 21 | no |
| 0.3 | 1.0 | 26 | no |
| 2.0 | 4.5 | 23 | no |
| 3.0 | 7.0 | 27 | slight |

EXAMPLE 3

The water-swollen AN fiber obtained in Example 1 was immersed in 0.5% aqueous solution of the various compounds shown in Table 3 and was dried at 120° C. for 3 minutes. These fibers containing such compounds respectively were heat-treated at 200° C. for 2 minutes at a definite length. These fibers were then examined for the heat decomposition accelerating effect by obtaining the ratio of undissolved matter in a 60% aqueous sodium thiocyanate solution at 80° C. for 20 minutes. The heat-treated fibers were subjected to thermal stabilization treatment by passing the fibers continuously through an electric furnace, 106 cm. in length, having a continuous temperature gradient of from 200° C. to 280° C., in an aerial atmosphere, under a tension of 0.35 g/d for 25 minutes. The thermally stabilized fibers were then carbonized by passing the fibers continuously through an electric furnace, 120 cm. in length, having a continuous temperature gradient of from 300° C. to 1300° C., in a nitrogen atmosphere for 9 minutes. The thus obtained carbon fibers were measured for physical properties. The results are shown in Table 3. As apparent from the results in Table 3, carbon fibers of high tensile strength and high modulus of elasticity were obtained by impregnating the fibers with the primary amines or quaternary ammonium salts according to the present invention.

Table 3

| | Compound | | Undissolved matter (%) | Adhesion of thermally stabilized fibers | Physical properties of carbon fibers | |
|---|---|---|---|---|---|---|
| | Kind | Content (%) | | | Tensile strength (kg/mm²) | Young's modulus (ton/mm²) |
| | Hexylamine | 1.48 | 6 | occurred | Measurement impossible | Measurement impossible |
| Comparative examples | Octadecylamine | 1.10 | 22 | " | 203 | 19 |
| | Hexyl trimethyl-ammonium chloride | 1.70 | 7 | " | 97 | 14 |

Table 3-continued

| | Compound Kind | Content (%) | Undissolved matter (%) | Adhesion of thermally stabilized fibers | Physical properties of carbon fibers: Tensile strength (kg/mm²) | Young's modulus (ton/mm²) |
|---|---|---|---|---|---|---|
| | Octadecyl trimethylammonium chloride | 1.23 | 21 | " | 183 | 18 |
| Present invention | Heptylamine | 1.53 | 20 | did not occur | 231 | 24 |
| | Tridecylamine | 1.51 | 24 | " | 273 | 23 |
| | Cetylamine | 1.28 | 21 | " | 263 | 24 |
| | Decyl trimethylammonium chloride | 1.48 | 25 | " | 251 | 23 |
| | Decyl triethylammonium chloride | 1.32 | 26 | " | 267 | 25 |
| | Decyl trimethylammonium bromide | 1.62 | 25 | " | 259 | 24 |

EXAMPLE 4

The water-swollen AN fiber obtained in Example 1 was impregnated with a 0.2% aqueous solution of undecyl trimethylammonium chloride and was dried at 120° C. for 3 minutes. A fiber containing 0.72% of the above-mentioned compound was obtained. The fiber containing the compound was subjected to various heat treatments shown in Table 4, respectively. These heat-treated fibers were measured for the ratio of undissolved matter in a 60% aqueous sodium thiocyanate solution. The heat-treated fibers were thermally stabilized by continuously heating the fibers through the firing furnace in Example 3, in an aerial atmosphere under a tension of 0.35 g/d at a temperature rise speed of 8° C./min. up to 300° C., and thereafter carbonized according to the carbonizing condition in Example 3. Physical properties of the thus-obtained carbon fibers are shown in Table 4.

As apparent from the results in Table 4, it will be understood that, when the ratio of undissolved matter in the 60% aqueous sodium thiocyanate solution is within 20 – 80%, carbon fibers of excellent physical properties can be obtained.

Table 4

| Heat treatment condition | Undissolved matter (%) | Physical properties of carbon fiber: Tensile strength (kg/mm²) | Young's modulus (ton/mm²) |
|---|---|---|---|
| 200° C. × 30 min. | 54 | 252 | 23 |
| 200° C. × 60 min. | 83 | 210 | 19 |
| 550° C. × 0.1 sec. | 18 | Fiber broke in thermal stabilization step. | |
| 550° C. × 0.3 sec. | 61 | 260 | 22 |
| 680° C. × 0.1 sec. | 94 | Fiber broke in thermal stabilization step. | |

EXAMPLE 5

A spinning solution obtained by dissolving 15 parts of an AN copolymer containing 97% AN into 85 parts of a 48% aqueous sodium thiocyanate solution, was extruded through a spinnerette having 1000 spinning orifices into a 12% aqueous sodium thiocyanate solution to form coagulated filaments. The coagulated filaments were washed with water and stretched 6 times the length in hot water, whereby a water-swollen AN fiber having a single filament fineness of 1.3 denier was obtained. The water-swollen fiber (water content: 169%) was treated in a 2% aqueous nonylamine solution and was stretched 2 times the length in saturated steam at 135° C. The fiber was then dried for 3 minutes by using drying rollers heated to 115° C. Thus, an AN fiber containing 3.2% of the above-mentioned amine was obtained.

The amine-containing fiber thus obtained was doubled to form a yarn of 5200 denier and was subjected to heat treatment at 178° C. for 12 minutes under a tension of 2340 g. The fiber was then subjected to thermal stabilization treatment in an aerial atmosphere under a tension of 2340 g., with a rapid temperature rise at the rate of 6° C./min. up to 280° C. Further, the fiber was carbonized under the condition of Example 3. A carbon fiber having excellent physical properties of 272 kg/mm² in tensile strength and 24 ton/mm² in Young's modulus was obtained.

On the other hand, when the fiber was subjected to thermal stabilization treatment without being subjected to the heat treatment of 178° C. for 12 minutes, filament breaking occurred and continuation of thermal stabilization treatment was impossible. When the tension upon thermal stabilization applied to the fiber not subjected to said heat treatment was lowered to 1560 g., the filament breaking was avoided but the thus-obtained carbon fiber represented very low physical properties, with the tensile strength being 197 kg/mm² and the Young's modulus being 14 ton/mm².

EXAMPLE 6

The water-swollen AN fiber obtained in Example 5 was impregnated with a 1% aquepus dodecylamine solution and then dried at 140° C. for 2 minutes. The fiber thus obtained is referred to as Fiber (I). The same dried fiber but without being subjected to the above-mentioned amine treatment is referred to as Fiber (II). The amine content of Fiber (I) was 2.7%.

The two kinds of fibers were treated at a temperature of 200° C. for 20 minutes, respectively. These fibers were then thermally stabilized in the electric furnace of Example 3, in an aerial atmosphere under a tension of 0.2 g/d, with the temperature being continuously raised up to 280° C. under the temperature rise conditions shown in Table 5, and thereafter produced into carbon fibers in a nitrogen atmosphere according to the method of Example 3.

Physical properties of the carbon fibers thus obtained are shown in Table 5. As is seen, by following the process of the present invention, the time length for thermal stabilization can be remarkably shortened and the carbon fibers of high physical properties can be produced advantageously.

Table 5

| | Fiber (I) | | | Fiber (II) | | |
|---|---|---|---|---|---|---|
| Temperature rise speed (° C./min.) | 2 | 4 | 6 | 2 | 4 | 6 |
| Tensile strength (kg/mm²) | 271 | 251 | 275 | 233 | 176 | Measurement impossible because of fiber adhesion |
| Young's modulus (ton/mm²) | 24 | 23 | 24 | 22 | 15 | |

One kind of the carbon fibers from Fiber (I) (that obtained under the condition of 2° C./min.) and one kind of the carbon fibers from Fiber (II) (that obtained under the condition of 2° C./min.) were used as reinforcing materials for preparing fiber-reinforced resins. The resin reinforced with the former carbon fiber represented a shear strength of 7.1 kg/mm², while that of the resin reinforced with the latter carbon fiber was only 6.0 kg/mm¹. In this connection, as the resin and hardener, an epoxy thermosetting resin Epocoat No. 828 (Shell Chemical) and a hardener DMP-30 (Shell Chemical) were used. A curing treatment condition of 90° C. for one hour and a post-curing treatment condition of 170° C. for 2 hours were employed. The filling amount of the carbon fibers was 40 volume percent.

What is claimed is:

1. A process for producing a carbon fiber which comprises (a) impregnating a water-swollen acrylonitrile fiber containing at least 85 mol % acrylonitrile with 0.05 – 5%, based on the dry weight of the fiber, of at least one compound represented by the following general formula (I) or (II):

$$R_1\text{-}NH_2 \qquad \text{(I)}$$

$$\left[ R_2-\overset{\overset{R_3}{|}}{\underset{\underset{R_5}{|}}{N}}-R_4 \right]^+ \cdot X^- \qquad \text{(II)}$$

wherein $R_1$ is a hydrocarbon group containing 7 – 16 carbon atoms; $R_2$, $R_3$, $R_4$ and $R_5$ are each a hydrocarbon group containing 1 – 16 carbon atoms, with at least one of $R_2$, $R_3$, $R_4$ and $R_5$ being a hydrocarbon group containing 7 – 16 carbon atoms; and X is a monovalent anion; (b) heat treating the fiber at a temperature of at least 150° C. for 0.1 second to 30 minutes so as to render the fiber to have 20 – 80 weight percent undissolved matter upon being immersed in a 60% aqueous sodium thiocyanate solution at 80° C. for 20 minutes; (c) thermally stabilizing the fiber by heating under tension in an oxidizing atmosphere at a temperature of from 150° C. to 400° C. and thereafter (d) carbonizing or carbonizing and then graphitizing under tension in a non-oxidizing atmosphere at a temperature above 800° C.

2. The process as claimed in claim 1 wherein the fiber is impregnated with 0.1 – 3% of the primary amines and/or quaternary ammonium salts.

3. The process as claimed in claim 1 wherein the heat treatment temperature in step (b) is 160° C. to 550° C..

4. The process as claimed in claim 1 wherein the heat treating time in step (b) is 0.2 second to 20 minutes.

Figure 2:
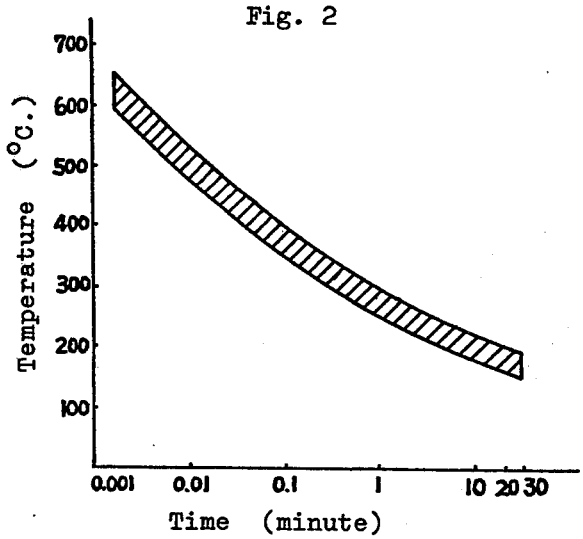
FIG. 2 represents the preferable temperature-time range upon heat-treating AN fibers containing the specified compounds according to the present invention.

5. The process as claimed in claim 1 wherein a condition in the temperature-time area shown by slanting lines in FIG. 2 is employed in heat treating the fiber in step (b).

6. The process as claimed in claim 1 wherein the water content of the acrylonitrile fiber in a water-swollen state is 20 to 200 percent.

7. The process as claimed in claim 1 wherein the primary amine is a compound selected from the group consisting of nonylamine, dodecylamine, tridecylamine and cetylamine.

8. The process as claimed in claim 1 wherein the quaternary ammonium salt is a compound selected from the group consisting of decyl trimethylammonium chloride, decyl triethylammonium chloride, undecyl trimethylammonium chloride, dodecyl trimethylammonium chloride and tridecyl trimethylammonium bromide.

9. The process as claimed in claim 1 wherein the water-swollen acrylonitrile fiber impregnated with at least one compound selected from said primary amines and/or quaternary ammonium salts is dried and then heat-treated.

10. The process as claimed in claim 1 wherein the oxidizing atmosphere is air.

11. The process as claimed in claim 1 wherein the thermally stabilized fiber is carbonized in a non-oxidizing atmosphere at a temperature of from 800° C to 2000° C. and then graphitized in a non-oxidizing atmosphere at a temperature of from 2000° C. to 3500° C..

12. The process as claimed in claim 1 wherein the non-oxidizing atmosphere is nitrogen.

* * * * *